US012747891B2

(12) United States Patent
Nishimura et al.

(10) Patent No.: US 12,747,891 B2
(45) Date of Patent: Sep. 29, 2026

(54) HOT WATER STORAGE TANK

(71) Applicant: Mitsubishi Electric Corporation, Tokyo (JP)

(72) Inventors: Yuriko Nishimura, Tokyo (JP); Junichi Nakazono, Tokyo (JP); Yoshikazu Yaji, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 412 days.

(21) Appl. No.: 18/287,647

(22) PCT Filed: Apr. 28, 2021

(86) PCT No.: PCT/JP2021/016880

§ 371 (c)(1),
(2) Date: Oct. 20, 2023

(87) PCT Pub. No.: WO2022/230076

PCT Pub. Date: Nov. 3, 2022

(65) Prior Publication Data

US 2024/0183624 A1 Jun. 6, 2024

(51) Int. Cl.
*F24H 9/02* (2006.01)
*F24H 1/18* (2022.01)
(Continued)

(52) U.S. Cl.
CPC ..... *F24H 9/02* (2013.01); *F24H 1/182* (2013.01); *F24H 9/06* (2013.01); *F24H 9/133* (2022.01); *F24H 9/14* (2013.01)

(58) Field of Classification Search
CPC ... F24H 9/02; F24H 1/182; F24H 9/06; F24H 9/133; F24H 9/14
See application file for complete search history.

(56) References Cited

FOREIGN PATENT DOCUMENTS

DE 299 07 752 U1 8/1999
DE 10 2006 019 583 A1 11/2007
(Continued)

OTHER PUBLICATIONS

JP-2009047375-A translation (Year: 2026).*
(Continued)

*Primary Examiner* — Michael G Hoang
*Assistant Examiner* — Kurt J Wolford
(74) *Attorney, Agent, or Firm* — XSENSUS LLP

(57) ABSTRACT

A hot water storage tank includes a tank body that stores a liquid; a lower heat insulating material covering a lower part of the tank body; a middle heat insulating material connected to the lower heat insulating material, the middle heat insulating material covering a side part of the tank body; and an upper heat insulating material connected to the middle heat insulating material, the upper heat insulating material covering an upper part of the tank body. A lower end face of the upper heat insulating material and an upper end face of the middle heat insulating material are inclined downward from insides toward outsides. An outer diameter of the middle heat insulating material is larger than an outer diameter of the upper heat insulating material and the outer diameter of the middle heat insulating material is larger than an outer diameter of the lower heat insulating material.

17 Claims, 10 Drawing Sheets

(51) Int. Cl.

| | |
|---|---|
| ***F24H 9/06*** | (2006.01) |
| ***F24H 9/13*** | (2022.01) |
| ***F24H 9/14*** | (2006.01) |

(56) References Cited

FOREIGN PATENT DOCUMENTS

| | | | | |
|---|---|---|---|---|
| DE | 202009002954 | U1 | | 5/2009 |
| JP | 2004-251521 | A | | 9/2004 |
| JP | 2009047375 | A | * | 3/2009 |
| JP | 4747869 | B2 | | 8/2011 |
| JP | 2012-247080 | A | | 12/2012 |
| JP | 2014-219110 | A | | 11/2014 |
| JP | 2015-108470 | A | | 6/2015 |
| JP | 2015-140953 | A | | 8/2015 |
| JP | 2015-215134 | A | | 12/2015 |
| JP | 2016-191484 | A | | 11/2016 |
| JP | 2020-176758 | A | | 10/2020 |
| WO | WO-2020021293 | A1 | * | 1/2020 ..... F24H 7/0433 |

OTHER PUBLICATIONS

Office Action issued Jan. 16, 2024 in Japanese Patent Application No. 2023-516922, 13 pages.
Office Action issued Sep. 23, 2025 in Chinese Patent Application No. 202180097377.1, 12 pages.
Office Action issued May 14, 2025 in Chinese Patent Application No. 202180097377.1, 13 pages.
International Search Report and Written Opinion mailed on Jul. 13, 2021, received for PCT Application PCT/JP2021/016880, filed on Apr. 28, 2021, 12 pages including English Translation.
Extended European Search Report issued May 8, 2024 in European Patent Application No. 21939237.0, 7 pages.

* cited by examiner (a)

(b)

HOT WATER STORAGE TANK

CROSS-REFERENCE TO RELATED APPLICATION

This application is based on PCT filing PCT/JP2021/016880, filed Apr. 28, 2021, the entire contents of which are incorporated herein by reference.

TECHNICAL FIELD

The present disclosure relates to a hot water storage tank including heat insulating materials.

BACKGROUND ART

An existing known hot water storage tank includes a plurality of heat insulating materials that are disposed around a tank body and that each have a predetermined shape. The plurality of heat insulating materials are used to improve the ease of assembly and reduce costs. Meanwhile, dimensional variations may occur in the tank body or the heat insulating materials. Thus, when the plurality of heat insulating materials are assembled, gaps may be left between the plurality of heat insulating materials. In this case, heat may be transferred from the tank body through the gaps between the plurality of heat insulating materials, and the heat insulating performance of the hot water storage tank is thus impaired to impair the energy-saving performance of a hot water supply system.

A hot water storage tank in Patent Literature 1 includes three separate vacuum heat insulating materials that are an upper vacuum heat insulating material, a middle vacuum heat insulating material, and a lower vacuum heat insulating material and has a configuration in which parts where the vacuum heat insulating materials are connected have inclined surfaces that are inclined downward from the insides toward the outsides and that are covered with covering materials covering the respective outer peripheries of the vacuum heat insulating materials. The hot water storage tank in Patent Literature 1 inhibits heat transfer from a tank body with this configuration to improve the energy-saving performance of a hot water supply system.

CITATION LIST

Patent Literature

Patent Literature 1: Japanese Unexamined Patent Application Publication No. 2012-247080

SUMMARY OF INVENTION

Technical Problem

However, when the hot water storage tank disclosed in Patent Literature 1 has variations in dimension such as the thickness and the diameter of the upper heat insulating material in a lateral direction, the upper heat insulating material may be shifted from a proper position and thus disposed above the middle heat insulating material. In this case, a large surface area of the tank body may be exposed, and heat thus may be transferred from the tank body.

The present disclosure is made to solve such a problem and provides a hot water storage tank that inhibits heat transfer from a tank body even when variations are present in the dimensions of heat insulating materials and the tank body in a height direction and a lateral direction.

Solution to Problem

A hot water storage tank according to an embodiment of the present disclosure includes a tank body that stores a liquid; a lower heat insulating material covering a lower part of the tank body; a middle heat insulating material connected to the lower heat insulating material, the middle heat insulating material covering a side part of the tank body; and an upper heat insulating material connected to the middle heat insulating material, the upper heat insulating material covering an upper part of the tank body. A lower end face of the upper heat insulating material and an upper end face of the middle heat insulating material are inclined downward from insides toward outsides. An outer diameter of the middle heat insulating material is larger than an outer diameter of the upper heat insulating material and the outer diameter of the middle heat insulating material is larger than an outer diameter of the lower heat insulating material.

Advantageous Effects of Invention

The lower end face of the upper heat insulating material and the upper end face of the middle heat insulating material of the hot water storage tank according to an embodiment of the present disclosure are inclined downward from the insides toward the outsides. In addition, the outer diameter of the middle heat insulating material is larger than each of the outer diameter of the upper heat insulating material and the outer diameter of the lower heat insulating material. Accordingly, the lower end face of the upper heat insulating material is disposed at a position to be in close contact with the upper end face of the middle heat insulating material, thus preventing exposure of the tank body. Thus, the hot water storage tank is capable of inhibiting heat transfer from the tank body even when variations are present in the dimensions of the heat insulating materials and the tank body in a height direction and a lateral direction.

DESCRIPTION OF EMBODIMENTS

Figure 1:
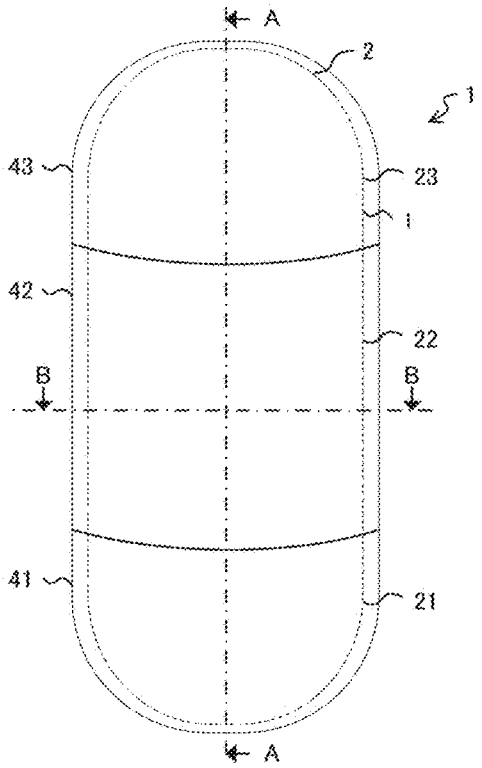
FIG. 1 is a schematic diagram illustrating a hot water storage tank 1 according to Embodiment 1.

Embodiments of the present disclosure will be described below with reference to the drawings. In the drawings, components having the same reference signs are the same or corresponding components, and this applies to the entire description. The following description using terms that each mean a direction such as "up" and "down" is based on directions when a hot water storage tank 1 is installed.

Embodiment 1

FIG. 1 is a schematic diagram illustrating the hot water storage tank 1 according to Embodiment 1. The hot water storage tank 1 is a columnar tank that stores a liquid such as water and hot water. In the following description, "water" refers to unheated water, and "hot water" refers to heated water. The hot water storage tank 1 includes a tank body 2, a lower heat insulating material 41, a middle heat insulating material 42, and an upper heat insulating material 43. Hereinafter, the lower heat insulating material 41, the middle heat insulating material 42, and the upper heat insulating material 43 may be generically referred to as a heat insulating material. The tank body 2 is formed by a bottom 21, a side 22, and a top 23. The tank body 2 and the heat insulating materials are described later.

Figure 2:
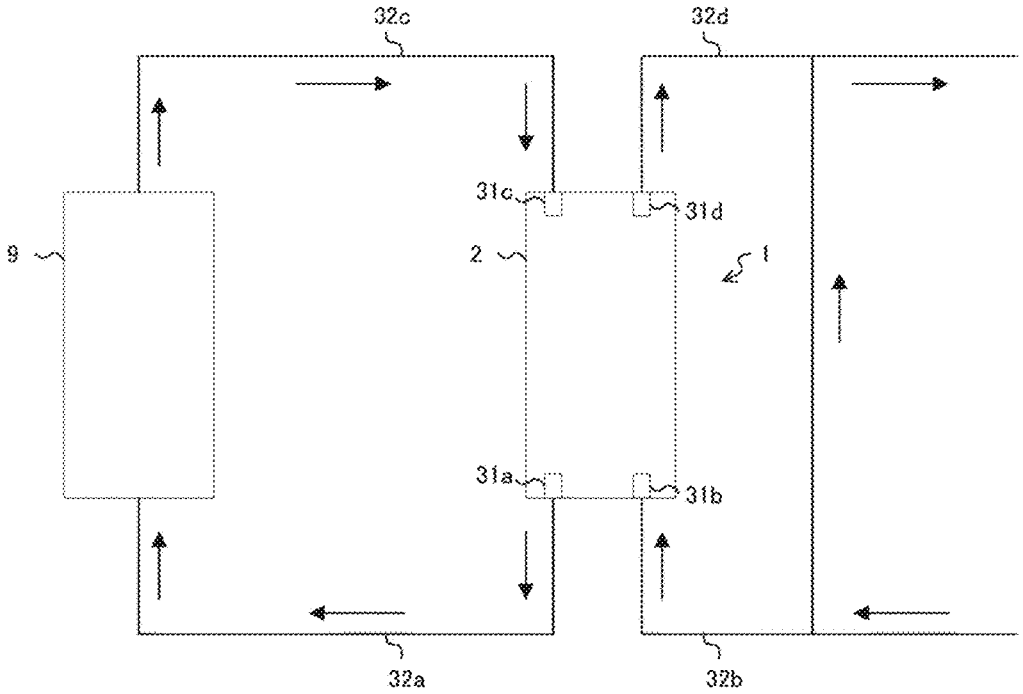
FIG. 2 is a schematic configuration diagram illustrating pipes and the hot water storage tank 1 in Embodiment 1.

FIG. 2 is a schematic configuration diagram illustrating pipes and the hot water storage tank 1 in Embodiment 1. As illustrated in FIG. 2, the tank body 2 is connected to a bottom pipe 32*a*, a water supply pipe 32*b*, an upper pipe 32*c*, and a hot water supply pipe 32*d*, through which water or hot water flows. Hereinafter, the bottom pipe 32*a*, the water supply pipe 32*b*, the upper pipe 32*c*, and the hot water supply pipe 32*d* may be generically referred to as a pipe.

An inlet of the bottom pipe 32*a* is connected to an ejection port 31*a* provided in a lower part of the tank body 2. An outlet of the bottom pipe 32*a* is connected to a heater 9. An inlet of the water supply pipe 32*b* is connected to a pipe (not illustrated) for supplying, for example, city water. The water supply pipe 32*b* has branched outlets, one of which is connected to an ejection port 31*b* provided in the lower part of the tank body 2 and the other of which is connected to the hot water supply pipe 32*d*.

An inlet of the upper pipe 32*c* is connected to the heater 9. An outlet of the upper pipe 32*c* is connected to an ejection port 31*c* provided in an upper part of the tank body 2. An inlet of the hot water supply pipe 32*d* is connected to an ejection port 31*d* provided in the upper part of the tank body 2. An outlet of the hot water supply pipe 32*d* is connected to, for example, a use-side pipe (not illustrated). Hereinafter, the ejection ports 31*a* to 31*d* may be generically referred to as an ejection port.

The hot water storage tank 1 stores and discharges hot water as follows. First, water stored in the tank body 2 is sent to the heater 9 through the bottom pipe 32*a* and is heated. The heated water returns to the upper part in the tank body 2 through the upper pipe 32*c*. When water is supplied to the tank body 2 from the outside, the water is supplied to the lower part of the tank body 2 through the water supply pipe 32*b*.

The water supplied to the lower part of the tank body 2 pushes up hot water stored in the tank body 2. Thus, the hot water is discharged to the outside through the hot water supply pipe 32*d* connected to the upper part of the tank body 2. Then, the hot water supplied through the hot water supply pipe 32*d* and water supplied through the water supply pipe 32*b* are mixed to generate and supply hot water having a user-desired temperature.

Immediately after the tank body 2 stores hot water, the tank body 2 is filled with uniformly high-temperature hot water. However, with the lapse of time, storing and discharging hot water cause the tank body 2 to have high temperature in the upper part of the tank body 2 and low temperature in the lower part of the tank body 2, thus forming a thermal boundary layer. This is because the specific gravity of water varies with temperature, and high-temperature water thus has a low specific gravity.

Figure 3:
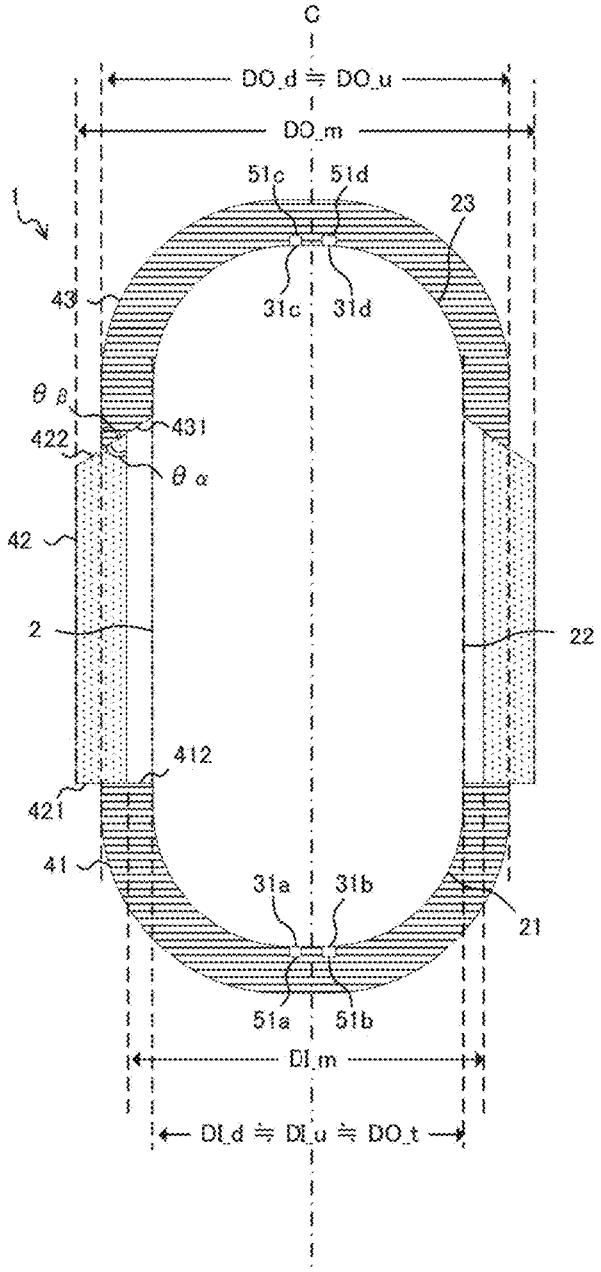
FIG. 3 is a schematic sectional view illustrating the hot water storage tank 1 according to Embodiment 1.

FIG. 3 is a schematic sectional view illustrating the hot water storage tank 1 according to Embodiment 1. FIG. 3 illustrates a section of the hot water storage tank 1 in the vertical direction, that is, a section taken along A-A in FIG. 1. As illustrated in FIG. 3, the hot water storage tank 1 includes the tank body 2, the lower heat insulating material 41, the middle heat insulating material 42, and the upper heat insulating material 43. Hereinafter, the pipes are not illustrated.

The exterior of the tank body 2 has a columnar shape, and the interior of the tank body 2 is hollow. The tank body 2 has a shape substantially symmetrical about a central axis C. The tank body 2 is formed by the bottom 21, the side 22, and the top 23. The bottom 21 corresponds to a lower hemispherical part of the tank body 2. The side 22 is connected to the bottom 21 and corresponds to a cylindrical part of the tank body 2. The top 23 is connected to the side 22 and corresponds to an upper hemispherical part of the tank body 2.

The bottom 21 of the tank body 2 has the ejection port 31*a* and the ejection port 31*b*. The inlet of the bottom pipe 32*a* is connected to the ejection port 31*a*. An outlet of the water supply pipe 32*b* is connected to the ejection port 31*b*.

The top 23 of the tank body 2 has the ejection port 31*c* and the ejection port 31*d*. The outlet of the upper pipe 32*c* is connected to the ejection port 31*c*. The inlet of the hot water supply pipe 32*d* is connected to the ejection port 31*d*.

The lower heat insulating material 41, the middle heat insulating material 42, and the upper heat insulating material 43 are, for example, heat insulating foam materials made of polystyrene foam. The lower heat insulating material 41, the middle heat insulating material 42, and the upper heat insulating material 43 cause the tank body 2 and the surrounding air to be thermally insulated from each other. The lower heat insulating material 41 and the middle heat insulating material 42 are connected to each other. In addition, the middle heat insulating material 42 and the upper heat insulating material 43 are connected to each other.

The lower heat insulating material 41 has a substantially hemispherical hollow shape. The lower heat insulating material 41 covers the bottom 21 and a part, located lower than the center of the side 22, of the side 22 of the tank body 2. The lower heat insulating material 41 is in contact with the bottom 21 and the side 22 of the tank body 2. The lower heat insulating material 41 has insertion holes 51*a* and 51*b*. The insertion hole 51*a* communicates with the ejection port 31*a* and is a hole into which the bottom pipe 32*a* is inserted. The insertion hole 51*b* communicates with the ejection port 31*b* and is a hole into which the water supply pipe 32*b* is inserted. The provision of the insertion holes 51*a* and 51*b* reduces interference between the lower heat insulating material 41 and each of the bottom pipe 32*a* and the water supply pipe 32*b*. An entire upper end face 412 of the lower heat insulating material 41 is formed substantially horizontally.

The middle heat insulating material 42 has a substantially cylindrical hollow shape. The middle heat insulating material 42 covers a part, located higher than the part covered with the lower heat insulating material 41 and located lower than a part covered with the upper heat insulating material 43, of the side 22 of the tank body 2. An entire lower end face 421 of the middle heat insulating material 42 is formed substantially horizontally. The lower end face 421 of the middle heat insulating material 42 and the upper end face 412 of the lower heat insulating material 41 are in contact with each other.

An entire upper end face 422 of the middle heat insulating material 42 is formed as an inclined surface inclined downward from the inside toward the outside. In other words, the upper end face 422 of the middle heat insulating material 42 is formed to be inclined upward toward the central axis C in any section including the central axis C of the tank body 2 in the vertical direction.

The upper heat insulating material 43 has a substantially hemispherical hollow shape. The upper heat insulating material 43 covers the top 23 and a part, located higher than the center of the side 22, of the side 22 of the tank body 2. The upper heat insulating material 43 is in contact with the side 22 and the top 23 of the tank body 2. The upper heat insulating material 43 has insertion holes 51*c* and 51*d*. The insertion hole 51*c* communicates with the ejection port 31*c* and is a hole into which the upper pipe 32*c* is inserted. The insertion hole 51*d* communicates with the ejection port 31*d* and is a hole into which the hot water supply pipe 32*d* is inserted. The provision of the insertion holes 51*c* and 51*d* reduces interference between the upper heat insulating material 43 and each of the upper pipe 32*c* and the hot water supply pipe 32*d*. Hereinafter, the insertion holes 51*a* to 51*d* may be generically referred to as an insertion hole.

An entire lower end face 431 of the upper heat insulating material 43 is formed as an inclined surface inclined downward from the inside toward the outside. In other words, the lower end face 431 of the upper heat insulating material 43 is formed to be inclined upward toward the central axis C in any section including the central axis C of the tank body 2 in the vertical direction. In addition, the upper end face 422 of the middle heat insulating material 42 and the lower end face 431 of the upper heat insulating material 43 have substantially the same inclined angle and are in contact with each other. The inclined angle is determined by an angle $\theta\alpha$ formed between the upper end face 422 and an inner peripheral surface of the middle heat insulating material 42 and an angle $\theta\beta$ formed between the lower end face 431 and an outer peripheral surface of the upper heat insulating material 43 in a section of the tank body 2 in the vertical direction.

The dimensional relationships between the lower heat insulating material 41, the middle heat insulating material 42, and the upper heat insulating material 43 will be described. An inner diameter DI_d of the lower heat insulating material 41, an inner diameter DI_u of the upper heat insulating material 43, and an outer diameter DO_t of the tank body 2 are substantially the same as each other. An inner diameter DI_m of the middle heat insulating material 42 is larger than each of the inner diameter DI_d of the lower heat insulating material 41, the inner diameter DI_u of the upper heat insulating material 43, and the outer diameter DO_t of the tank body 2. That is, the distance between the inner peripheral surface of the middle heat insulating material 42 and a part, facing the inner peripheral surface of the middle heat insulating material 42, of an outer peripheral surface of the tank body 2 is larger than the distance between the upper end of an inner peripheral surface of the lower heat insulating material 41 and a part, facing the upper end of the inner peripheral surface of the lower heat insulating material 41, of the outer peripheral surface of the tank body 2. In addition, the distance between the inner peripheral surface of the middle heat insulating material 42 and a part, facing the inner peripheral surface of the middle heat insulating material 42, of the outer peripheral surface of the tank body 2 is larger than the distance between the lower end of an inner peripheral surface of the upper heat insulating material 43 and a part, facing the lower end of the inner peripheral surface of the upper heat insulating material 43, of the outer peripheral surface of the tank body 2. An outer diameter DO_d of the lower heat insulating material 41 and an outer diameter DO_u of the upper heat insulating material 43 are substantially the same as each other. Then, an outer diameter DO_m of the middle heat insulating material 42 is larger than each of the outer diameter DO_d of the lower heat insulating material 41 and the outer diameter DO_u of the upper heat insulating material 43. The inner diameter DI_d and the outer diameter DO_d of the lower heat insulating material 41, the inner diameter DI_u and the outer diameter DO_u of the upper heat insulating material 43, and the outer diameter DO_t of the tank body 2 are based on the respective maximum possible diameters.

As described above, the upper end face 422 of the middle heat insulating material 42 and the lower end face 431 of the upper heat insulating material 43 are inclined downward from the insides toward the outsides, and the outer diameter DO_m of the middle heat insulating material 42 is larger than each of the outer diameter DO_d of the lower heat insulating material 41 and the outer diameter DO_u of the upper heat insulating material 43. Accordingly, the lower end face 431 of the upper heat insulating material 43 is disposed at a position to be in close contact with the upper end face 422 of the middle heat insulating material 42 depending on variations in the dimensions of the heat insulating materials and the tank body 2 within a tolerance range, thus preventing exposure of the tank body 2.

Specifically, for example, when the diameter of the upper heat insulating material 43 is larger than a reference value, or when the dimension of the upper heat insulating material 43 in a height direction is larger than a reference value, the upper heat insulating material 43 is disposed at a position outside a reference position in the middle heat insulating material 42. On the other hand, when the diameter of the upper heat insulating material 43 is smaller than a reference value, or when the dimension of the upper heat insulating material 43 in the height direction is smaller than a reference value, the upper heat insulating material 43 is disposed at a position inside a reference position in the middle heat insulating material 42. As described above, the outer diameter DO_m of the middle heat insulating material 42 is larger than each of the outer diameter DO_d of the lower heat insulating material 41 and the outer diameter DO_u of the upper heat insulating material 43. Accordingly, even when the upper heat insulating material 43 is disposed at a position outside the reference position in the middle heat insulating material 42, the tank body 2 is inhibited from being exposed through a gap left between the middle heat insulating material 42 and the upper heat insulating material 43.

In addition, as described above, the inner diameter DI_m of the middle heat insulating material 42 is larger than each of the inner diameter DI_d of the lower heat insulating material 41 and the inner diameter DI_u of the upper heat insulating material 43. Accordingly, when the middle heat insulating material 42 is attached, a gap is left between the outer surface of the body of the hot water storage tank 1 and the inner surface of the middle heat insulating material 42. However, the tank body 2 in use bulges when, for example, hot water is stored in the tank body 2. Thus, the inner peripheral surface of the middle heat insulating material 42 is located along the side 22 of the tank body 2.

The lower heat insulating material 41, the middle heat insulating material 42, and the upper heat insulating material 43 are assembled in this order to the tank body 2 to manufacture the hot water storage tank 1. Before the assembly, the dimension of the inner peripheral surface of the middle heat insulating material 42 in the height direction is substantially the same as the dimension from a part, located at an inner periphery, of the upper end face 412 of the lower heat insulating material 41 to a part, located at the inner periphery, of the lower end face 431 of the upper heat insulating material 43. As described above, the inner diameter DI_m of the middle heat insulating material 42 is larger than each of the inner diameter DI_d of the lower heat insulating material 41 and the inner diameter DI_u of the upper heat insulating material 43. That is, after the assembly, the inner peripheral surface of the middle heat insulating material 42 is located further outside of the tank body 2 than the inner peripheral surface of the upper heat insulating material 43 and the inner peripheral surface of the lower heat insulating material 41. Accordingly, the middle heat insulating material 42 is assembled to be pushed between the upper heat insulating material 43 and the lower heat insulating material 41. Thus, after the assembly, the middle heat insulating material 42 is in extremely close contact with the upper heat insulating material 43.

According to Embodiment 1, the lower end face 431 of the upper heat insulating material 43 is disposed at a position to be in close contact with the upper end face 422 of the middle heat insulating material 42 depending on variations in the dimensions of the heat insulating materials and the tank body 2, thus preventing exposure of the tank body 2. Accordingly, the hot water storage tank 1 is capable of inhibiting heat transfer from the tank body 2 even when variations are present in the dimensions of the heat insulating materials and the tank body 2 in the height direction and a lateral direction.

In addition, according to Embodiment 1, the tank body 2 in use bulges when, for example, hot water is stored in the tank body 2. Thus, the inner peripheral surface of the middle heat insulating material 42 is located along the side 22 of the tank body 2. Accordingly, it is possible to further inhibit heat transfer from the tank body 2.

In addition, according to Embodiment 1, the lower heat insulating material 41 and the bottom 21 of the tank body 2 are in contact with each other, and the upper heat insulating material 43 and the top 23 of the tank body 2 are in contact with each other. Thus, it is possible to inhibit heat transfer from the insertion holes of the heat insulating materials as a result of entrance, into a gap between the lower heat insulating material 41 and the tank body 2 and a gap between the upper heat insulating material 43 and the tank body 2, of air, between the middle heat insulating material 42 and the tank body 2, heated by heat of the tank body 2.

Embodiment 2

Figure 4:
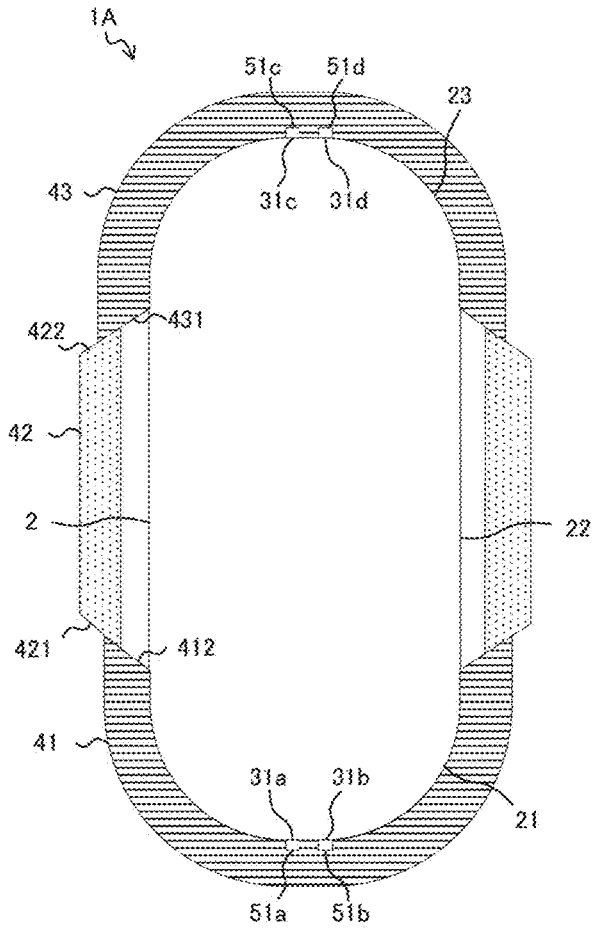
FIG. 4 is a schematic sectional view illustrating a hot water storage tank 1A according to Embodiment 2.

FIG. 4 is a schematic sectional view illustrating a hot water storage tank 1A according to Embodiment 2. FIG. 4 illustrates a section of the hot water storage tank 1A in the vertical direction, that is, a section corresponding to the section taken along A-A in FIG. 1. As illustrated in FIG. 4, Embodiment 2 differs from Embodiment 1 in that the upper end face 412 of the lower heat insulating material 41 and the lower end face 421 of the middle heat insulating material 42 and are formed as inclined surfaces inclined upward from the insides toward the outsides. In Embodiment 2, the same parts as those in Embodiment 1 have the same reference signs and are not described, and description is given with a focus on the difference between Embodiments 1 and 2.

In addition to the upper end face 422 of the middle heat insulating material 42 and the lower end face 431 of the upper heat insulating material 43 being inclined downward from the insides toward the outsides, the entire upper end face 412 of the lower heat insulating material 41 and the entire lower end face 421 of the middle heat insulating material 42 are inclined upward from the insides toward the outsides. In other words, the upper end face 412 of the lower heat insulating material 41 and the lower end face 421 of the middle heat insulating material 42 are formed to be inclined downward toward the central axis in any section including the central axis of the tank in the vertical direction. In addition, the lower end face 421 of the middle heat insulating material 42 and the upper end face 412 of the lower heat insulating material 41 have substantially the same inclined angle.

Accordingly, according to Embodiment 2, the upper end face 412 of the lower heat insulating material 41 is also disposed at a position to be in close contact with the lower end face 421 of the middle heat insulating material 42 depending on variations in the dimensions of the heat insulating materials and the tank body 2, thus preventing exposure of the tank body 2. In addition, even when such dimensional variations are large, the disposition of the heat insulating materials is adjusted as a whole. Thus, it is possible to prevent exposure of the tank body 2.

Embodiment 3

Figure 5:
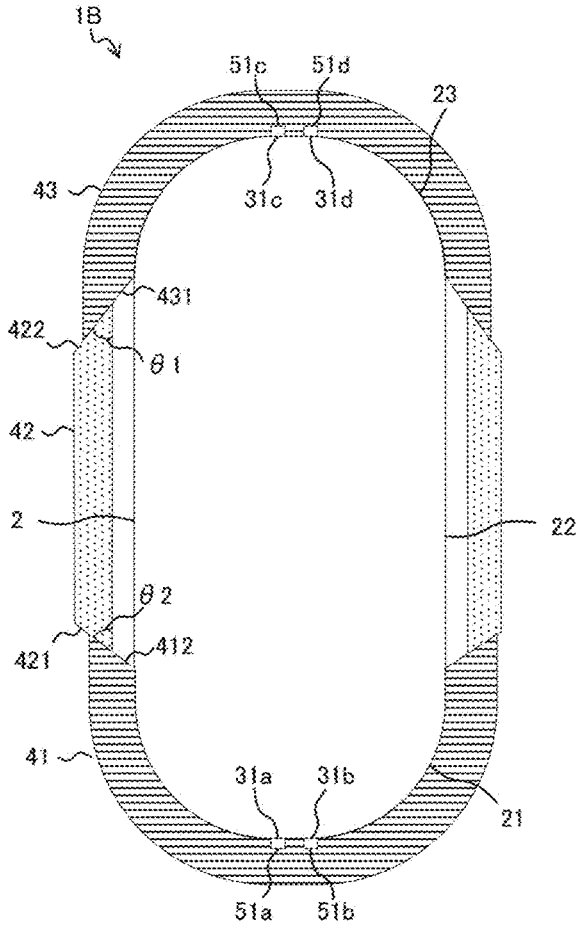
FIG. 5 is a schematic sectional view illustrating a hot water storage tank 1B according to Embodiment 3.

FIG. 5 is a schematic sectional view illustrating a hot water storage tank 1B according to Embodiment 3. FIG. 5 illustrates a section of the hot water storage tank 1B in the vertical direction, that is, a section corresponding to the section taken along A-A in FIG. 1. As illustrated in FIG. 5, Embodiment 3 differs from Embodiment 2 in that an inclined angle θ1 of the upper end face 422 of the middle heat insulating material 42 is smaller than an inclined angle θ2 of the lower end face 421 of the middle heat insulating material 42. In Embodiment 3, the same parts as those in Embodiment 2 have the same reference signs and are not described, and description is given with a focus on the difference between Embodiments 2 and 3.

The inclined angle θ1 of the upper end face 422 of the middle heat insulating material 42 is smaller than the inclined angle 82 of the lower end face 421 of the middle heat insulating material 42. Thus, the area where the upper end face 422 of the middle heat insulating material 42 and the lower end face 431 of the upper heat insulating material 43 are in contact with each other is larger than the area where the upper end face 412 of the lower heat insulating material 41 and the lower end face 421 of the middle heat insulating material 42 are in contact with each other.

As described above, the upper part of the tank body 2 has higher temperature than temperature of the lower part of the tank body 2, and the amount of heat transferred from the upper part of the tank body 2 is thus large. In Embodiment 3, even when the dimensional variations are large, the upper end face 422 of the middle heat insulating material 42 and the lower end face 431 of the upper heat insulating material 43 are more preferentially in close contact with each other than the upper end face 412 of the lower heat insulating material 41 and the lower end face 421 of the middle heat insulating material 42. Thus, it is possible to reduce the amount of heat transferred. In addition, a frictional force generated by the inclined surfaces formed by the upper end face 422 of the middle heat insulating material 42 and the lower end face 431 of the upper heat insulating material 43 is larger than a frictional force generated by the inclined surfaces formed by the upper end face 411 of the lower heat insulating material 41 and the lower end face 421 of the middle heat insulating material 42. Accordingly, it is possible to firmly fix the middle heat insulating material 42 and the upper heat insulating material 43 to each other. Thus, it is possible to intensively reduce the amount of heat transferred from the upper part of the tank body 2, from which the amount of heat transferred is likely to be large.

Embodiment 4

Figure 6:
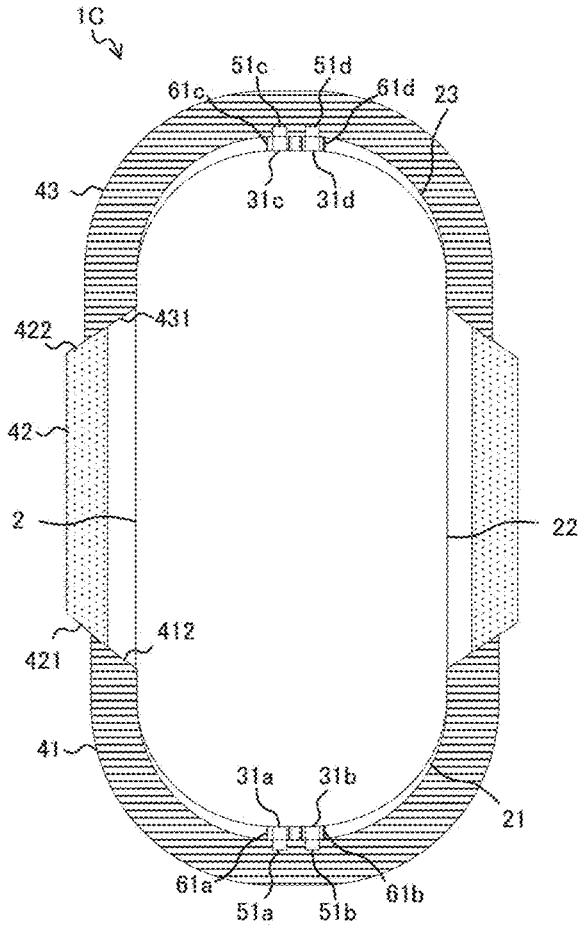
FIG. 6 is a schematic sectional view illustrating a hot water storage tank 1C according to Embodiment 4.

FIG. 6 is a schematic sectional view illustrating a hot water storage tank 1C according to Embodiment 4. FIG. 6 illustrates a section of the hot water storage tank 1C in the vertical direction, that is, a section corresponding to the section taken along A-A in FIG. 1. As illustrated in FIG. 6, Embodiment 4 differs from Embodiment 4 in that the hot water storage tank 1C includes cylindrical portions 61*a* to 61*d*. In Embodiment 4, the same parts as those in Embodiment 3 have the same reference signs and are not described, and description is given with a focus on the difference between Embodiments 3 and 4.

Figure 7:
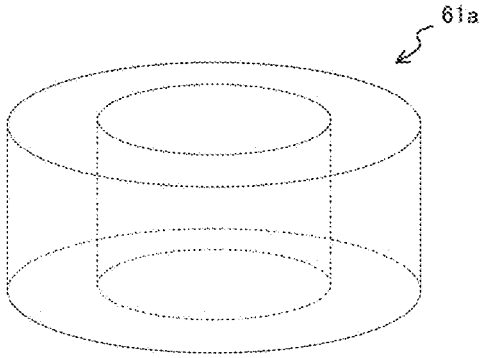
FIG. 7 is a schematic sectional view illustrating a cylindrical portion 61*a* according to Embodiment 4.

The hot water storage tank 1C includes the four cylindrical portions 61*a* to 61*d*. Hereinafter, the cylindrical portions 61*a* to 61*d* may be generically referred to as a cylindrical portion. FIG. 7 is a schematic sectional view illustrating the cylindrical portion 61*a* according to Embodiment 4. As illustrated in FIG. 7, the cylindrical portion 61*a* has an annular shape whose center has an opening passing through in an up-down direction. Although not illustrated, the cylindrical portions 61*b* to 61*d* have a shape similar to the shape of the cylindrical portion 61*a*.

The cylindrical portions 61 are made of a flexible material whose Young's modulus is smaller than the Young's modulus of a material to be used for the heat insulating materials. A smaller Young's modulus represents a higher degree of flexibility. For example, when polystyrene foam is used for the heat insulating materials, examples of a material having a Young's modulus smaller than the Young's modulus of polystyrene foam include polypropylene, PV, polyurethane, polyethylene, rubber, and polymer, which are used as foam and each have low chemical bonding strength. In addition, the Young's modulus of a material is reduced when the density of the material is reduced, that is, the proportion of air in the material is increased to cause the material to be spongiform.

With reference back to FIG. 6, the cylindrical portion 61*a* surrounds the ejection port 31*a*. The cylindrical portion 61*a* is attached such that a lower part of the cylindrical portion 61*a* is in close contact with the lower heat insulating material 41, that an upper part of the cylindrical portion 61*a* is in close contact with the bottom 21 of the tank body 2, and that an inner peripheral surface of the cylindrical portion 61*a* is in close contact with the bottom pipe 32*a*. The opening of the cylindrical portion 61*a* faces the ejection port 31*a*, which is provided at the bottom 21 of the tank body 2, for the bottom pipe 32*a*.

The cylindrical portion 61*b* surrounds the ejection port 31*b*. The cylindrical portion 61*b* is attached such that a lower part of the cylindrical portion 61*b* is in close contact with the lower heat insulating material 41, that an upper part of the cylindrical portion 61*b* is in close contact with the bottom 21 of the tank body 2, and that an inner peripheral surface of the cylindrical portion 61*b* is in close contact with the water supply pipe 32*b*. The opening of the cylindrical portion 61*b* faces the ejection port 31*b*, which is provided at the bottom 21 of the tank body 2, for the water supply pipe 32*b*.

The cylindrical portion 61*c* surrounds the ejection port 31*c*. The cylindrical portion 61*c* is attached such that a lower part of the cylindrical portion 61*c* is in close contact with the top 23 of the tank body 2, that an upper part of the cylindrical portion 61*c* is in close contact with the upper heat insulating material 43, and that an inner peripheral surface of the cylindrical portion 61*c* is in close contact with the upper pipe 32*c*. The opening of the cylindrical portion 61*c* faces the ejection port 31*c*, which is provided at the bottom 21 of the tank body 2, for the upper pipe 32*c*.

The cylindrical portion 61*d* surrounds the ejection port 31*d*. The cylindrical portion 61*d* is attached such that a lower part of the cylindrical portion 61*d* is in close contact with the top 23 of the tank body 2, that an upper part of the cylindrical portion 61*d* is in close contact with the upper heat insulating material 43, and that an inner peripheral surface of the cylindrical portion 61*d* is in close contact with the hot water supply pipe 32*d*. The opening of the cylindrical portion 61*d* faces the ejection port 31*d*, which is provided at the bottom 21 of the tank body 2, for the hot water supply pipe 32*d*.

The hot water storage tank 1C in Embodiment 4 includes the cylindrical portions 61*a* to 61*d*, which are located depending on the respective positions of the ejection ports 31*a* to 31*d*. This configuration inhibits heat transfer from the insertion holes as a result of entrance, into a gap between the lower heat insulating material 41 and the tank body 2 or a gap between the upper heat insulating material 43 and the tank body 2, of air, between the middle heat insulating material 42 and the tank body 2, heated by heat of the tank body 2. In addition, it is possible to inhibit entrance, onto the tank surface through the insertion holes in the lower part of the tank body 2, of air outside the hot water storage tank 1C.

In addition, according to Embodiment 4, the cylindrical portions are made of a material different from the material for the heat insulating materials. That is, the cylindrical portions are formed separately from the heat insulating materials. Accordingly, a metal mold for forming the lower heat insulating material 41 and the upper heat insulating material 43 can have a simple structure, thus improving the yield.

In addition, according to Embodiment 4, the cylindrical portions are made of a flexible material and thus deform to follow the complex structure around the ejection ports 31 of the tank body 2. Thus, a gap between the bottom 21 of the tank body 2 and each of the bottom pipe 32*a* and the water supply pipe 32*b* and a gap between the lower heat insulating material 41 and each of the bottom pipe 32*a* and the water supply pipe 32*b* are reduced. In addition, a gap between the top 23 of the tank body 2 and each of the upper pipe 32*c* and the hot water supply pipe 32*d* and a gap between the upper heat insulating material 43 and each of the upper pipe 32*c* and the hot water supply pipe 32*d* are reduced. As a result, air is further inhibited from passing through the insertion holes of the tank body 2. Thus, the amount of heat transferred from the tank body 2 is reduced.

Embodiment 5

Figure 8:
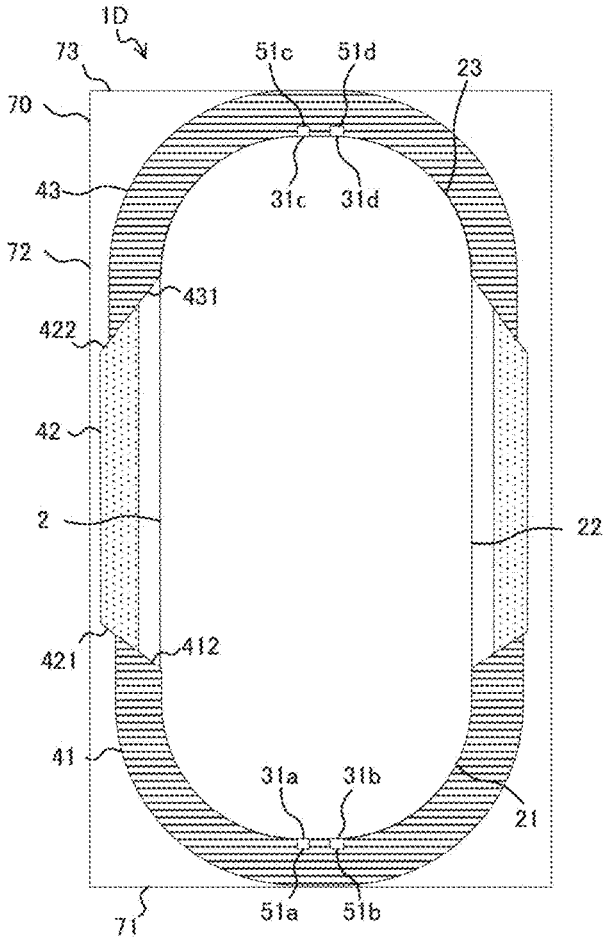
FIG. 8 is a schematic sectional view illustrating a hot water storage tank 1D according to Embodiment 5.

FIG. 8 is a schematic sectional view illustrating a hot water storage tank 1D according to Embodiment 5. FIG. 8 illustrates a section of the hot water storage tank 1D in the vertical direction, that is, a section corresponding to the section taken along A-A in FIG. 1. As illustrated in FIG. 8, Embodiment 5 differs from Embodiment 3 in that the hot water storage tank 1D includes a housing 70. In Embodiment 5, the same parts as those in Embodiment 3 have the same reference signs and are not described, and description is given with a focus on the difference between Embodiments 3 and 5.

The hot water storage tank 1D includes the tank body 2, the lower heat insulating material 41, the middle heat insulating material 42, the upper heat insulating material 43, and the housing 70, which houses a cylindrical portion 50. The housing 70 has a substantially cuboid shape and includes a bottom plate 71, side plates 72, and a top plate 73. The bottom plate 71 has a substantially quadrilateral shape and forms a lower part of the housing 70. The housing 70 includes the four side plates 72. The side plates 72 each have a substantially quadrilateral shape, are connected to the respective sides of the bottom plate 71 to stand up, and form side parts of the housing 70. The top plate 73 is connected to the side plates 72 and forms an upper part of the housing 70. The top plate 73 exerts downward force on the upper heat insulating material 43.

In Embodiment 5, the top plate 73 exerts downward force on the upper heat insulating material 43. Thus, the upper heat insulating material 43 and the top 23 of the tank body 2 are in close contact with each other. In addition, the lower heat insulating material 41 and the bottom 21 of the tank body 2 are in close contact with each other by receiving a force applied downward from the top plate 73. This configuration inhibits heat transfer from the insertion holes as a result of entrance, into a gap between the lower heat insulating material 41 and the tank body 2 or a gap between the upper heat insulating material 43 and the tank body 2, of air, between the middle heat insulating material 42 and the tank body 2, heated by heat of the tank body 2.

Embodiment 6

Figure 9:
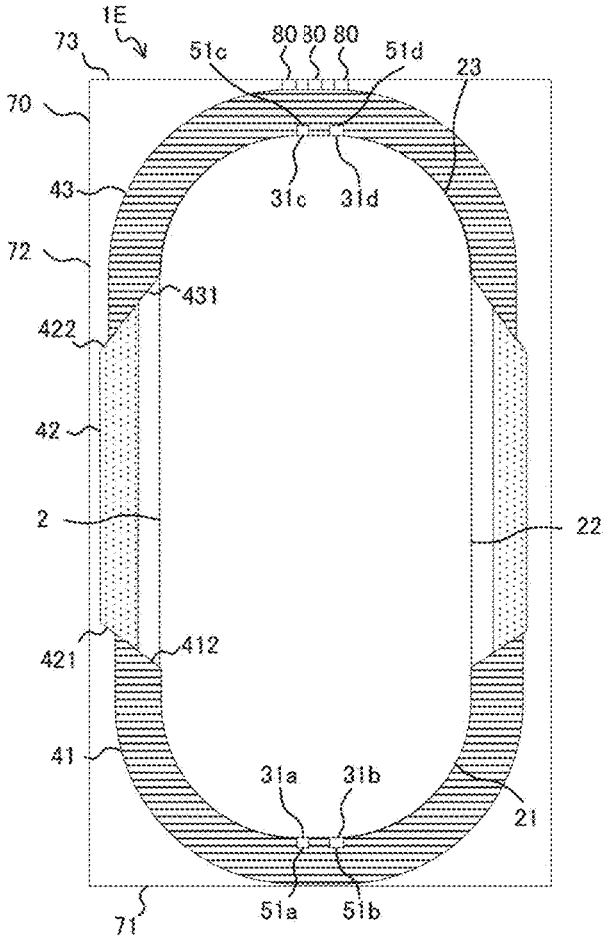
FIG. 9 is a schematic sectional view illustrating a hot water storage tank 1E according to Embodiment 6.
Figure 10:
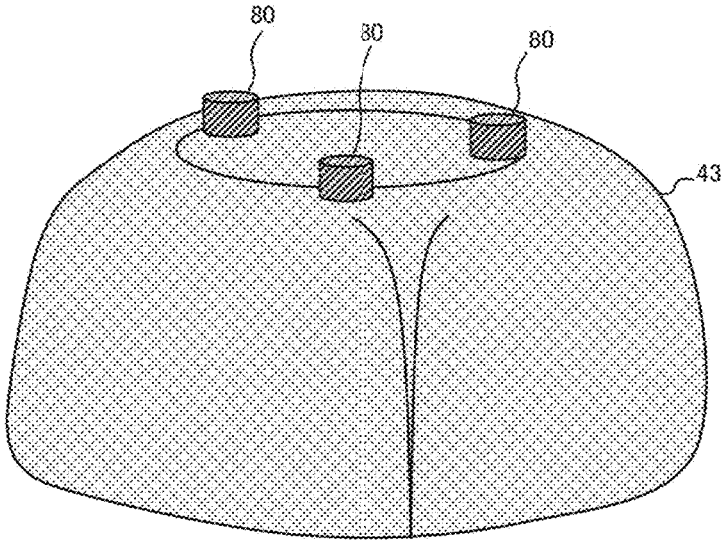
FIG. 10 is a top view illustrating contact portions 80 and an upper heat insulating material 43 according to Embodiment 6.
Figure 11:
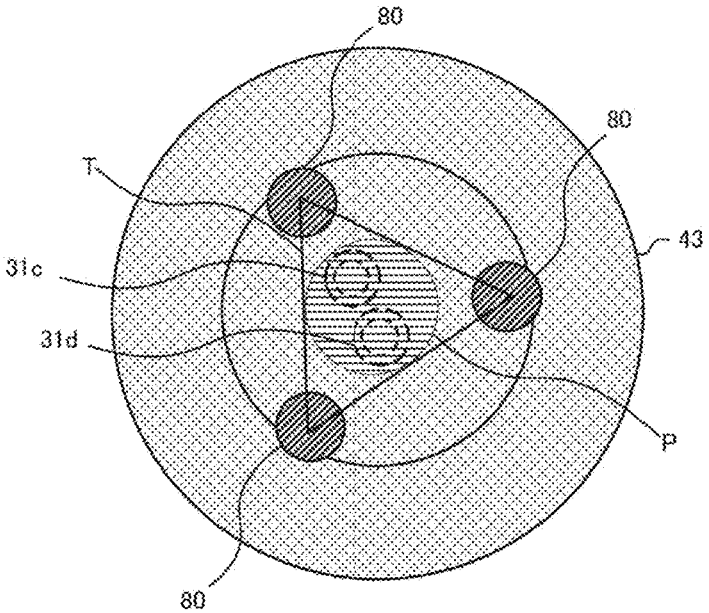
FIG. 11 is a perspective view illustrating the contact portions 80 and the upper heat insulating material 43 according to Embodiment 6.

FIG. 9 is a schematic sectional view illustrating a hot water storage tank 1E according to Embodiment 6. FIG. 10 is a top view illustrating contact portions 80 and the upper heat insulating material 43 according to Embodiment 6. FIG. 11 is a perspective view illustrating the contact portions 80 and the upper heat insulating material 43 according to Embodiment 6. As illustrated in FIGS. 9 to 11, Embodiment 6 differs from Embodiment 5 in that the three contact portions 80 are provided, between the upper heat insulating material 43 and the top plate 73, on the upper heat insulating material 43. In Embodiment 6, the same parts as those in Embodiment 5 have the same reference signs and are not described, and description is given with a focus on the difference between Embodiments 5 and 6.

The hot water storage tank 1E includes the three contact portions 80. The contact portions 80 are made of, for example, the same polystyrene foam as the polystyrene foam for the heat insulating materials. The upper heat insulating material 43 and the top plate 73 of the hot water storage tank 1E are in contact with each other at the three contact portions 80. The three contact portions 80 each have a columnar shape. The three contact portions 80 are located as the vertices of a triangle T on a plane. The ejection ports 31*a* and 31*b* for the upper pipe 32*c* and the hot water supply pipe 32*d* are formed inside the triangle T. That is, the top plate 73 exerts downward force on the upper heat insulating material 43 in the plane including the triangle T. Thus, the upper heat insulating material 43 and the top 23 of the tank body 2 are in extremely close contact with each other in a region P. The region P is a region that contains the ejection ports 31*a* and 31*b* at the top 23 of the tank body 2 and where an exerting force in the plane including the triangle T is concentrated.

According to Embodiment 6, the top plate 73 exerts downward force on the upper heat insulating material 43 in the plane including the three contact portions 80 forming the vertices of the triangle T. Thus, the upper heat insulating material 43 and the top 23 of the tank body 2 are in extremely close contact with each other in the region P. This configuration further inhibits heat transfer from the insertion holes as a result of entrance, into a gap between the upper heat insulating material 43 and the top 23 of the tank body 2, of air, between the middle heat insulating material 42 and the tank body 2, heated by heat of the tank body 2.

Embodiment 7

Figure 12:
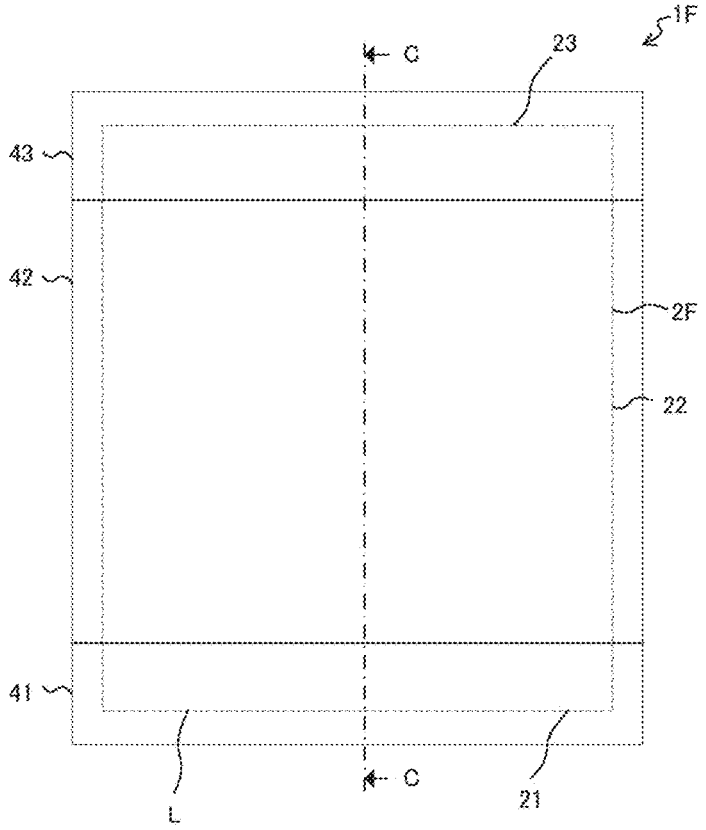
FIG. 12 is a schematic diagram illustrating a hot water storage tank 1F according to Embodiment 7.
Figure 13:
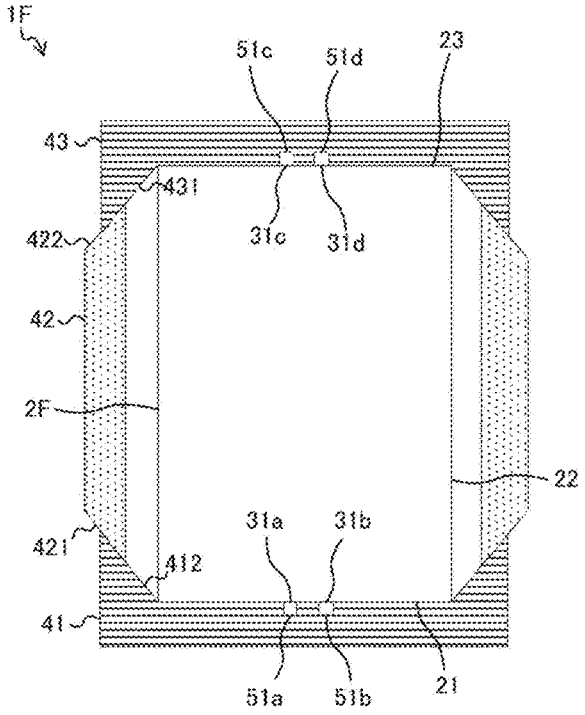
FIG. 13 is a schematic sectional view illustrating the hot water storage tank 1F according to Embodiment 7.

FIG. 12 is a schematic diagram illustrating a hot water storage tank 1F according to Embodiment 7. FIG. 13 is a schematic sectional view illustrating the hot water storage tank 1F according to Embodiment 7. FIG. 12 illustrates a long side L of the bottom 21 of a tank body 2F. FIG. 13 illustrates a section taken across the long side L in the vertical direction, that is, a section corresponding to a section taken along C-C in FIG. 12. As illustrated in FIGS. 12 and 13, Embodiment 7 differs from Embodiment 1 in that the hot water storage tank 1F and the tank body 2F each have a substantially cuboid shape. In Embodiment 7, the same parts as those in Embodiment 1 have the same reference signs and are not described, and description is given with a focus on the difference between Embodiments 5 and 7.

The hot water storage tank 1F and the tank body 2F each have a substantially cuboid shape. The lower heat insulating material 41 covers the bottom 21 and parts, located lower than the centers of the sides 22, of the sides 22 of the tank body 2. The lower heat insulating material 41 is in contact with only the bottom 21 and extends to the outside of the bottom 21 in four directions. The upper end face 412 of the lower heat insulating material 41 is formed as an inclined surface and obliquely faces the sides 22.

The middle heat insulating material 42 has a square tubular shape and covers a part, located higher than the part covered with the lower heat insulating material 41 and located lower than a part covered with the upper heat insulating material 43, of each of the sides 22 of the tank body 2.

The upper heat insulating material 43 covers the top 23 and parts, located higher than the centers of the sides 22, of the sides 22 of the tank body 2. The upper heat insulating material 43 is in contact with only the top 23 and extends to the outside of the top 23 in four directions. The lower end face 431 of the upper heat insulating material 43 is formed as an inclined surface and obliquely faces the sides 22.

The lower end face 421 of the middle heat insulating material 42 faces the sides 22 and is formed as an inclined surface inclined upward from the inside toward the outside. The upper end face 412 of the lower heat insulating material 41 and the lower end face 421 of the middle heat insulating material 42 have the same inclined angle and are in contact with each other. In addition, the upper end face 422 of the middle heat insulating material 42 faces the sides 22 and is formed as an inclined surface inclined downward from the inside toward the outside. The upper end face 422 of the middle heat insulating material 42 and the lower end face 431 of the upper heat insulating material 43 have the same inclined angle and are in contact with each other.

In general, in the case of the hot water storage tank 1F having a substantially cuboid shape, a part, in the vicinity of the long side L, of the tank body 2F in use is likely to bulge outward when hot water is stored in the tank body 2F. According to Embodiment 7, the surfaces, facing the side 22 connected to the long side L, of the middle heat insulating material 42 and the upper heat insulating material 43 are formed as inclined surfaces inclined downward from the insides toward the outsides. Thus, the middle heat insulating material 42 is capable of following the bulging tank. Accordingly, it is possible to reduce the amount of heat transferred from the tank body 2F.

Embodiments of the present disclosure have been described above. However, the present disclosure is not limited to the configurations of Embodiments described above, and various modifications and combinations can be made within the scope of the technical ideas. For example, polystyrene foam is used as an example of the material for the heat insulating materials. However, for example, polypropylene foam or urethane foam is usable instead of polystyrene foam. In addition, when polyurethane foam is used for the heat insulating foam materials, examples of a material having a Young's modulus smaller than the Young's modulus of polyurethane foam include polyethylene, rubber, and polymer, which are used as foam.

In addition, for example, in the description of Embodiment 1, the lower heat insulating material 41 and the bottom 21 of the tank body 2 are in contact with each other, and the upper heat insulating material 43 and the top 23 of the tank body 2 are in contact with each other. However, the lower heat insulating material 41 and the bottom 21 of the tank body 2 do not have to be in contact with each other. In addition, the upper heat insulating material 43 and the top 23 of the tank body 2 do not have to be in contact with each other. Also in this case, as long as the lower heat insulating material 41 and the side 22 of the tank body 2 are in contact with each other, it is possible to inhibit heat transfer from the insertion holes of the heat insulating materials as a result of entrance, into a gap between the lower heat insulating material 41 and the tank body 2, of air between the middle heat insulating material 42 and the tank body 2. Similarly, as long as the upper heat insulating material 43 and the side 22 of the tank body 2 are in contact with each other, it is possible to inhibit heat transfer from the insertion holes of the heat insulating materials as a result of entrance, into a gap between the upper heat insulating material 43 and the tank body 2, of air between the middle heat insulating material 42 and the tank body 2.

Figure 14:
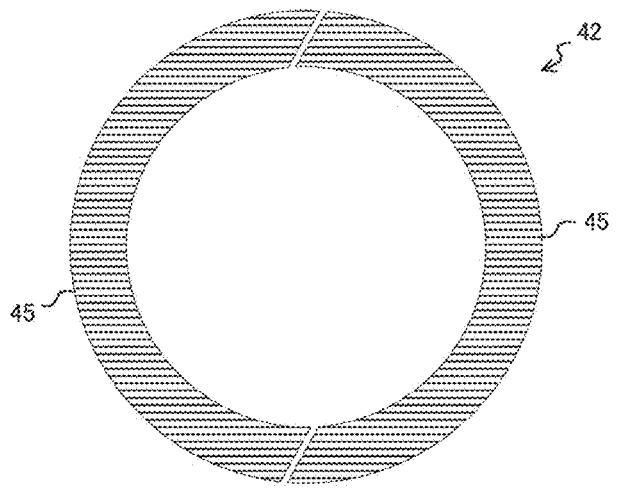
FIG. 14 includes schematic sectional views illustrating a middle heat insulating material 42 according to a modification example of Embodiment 1.
Figure 14:
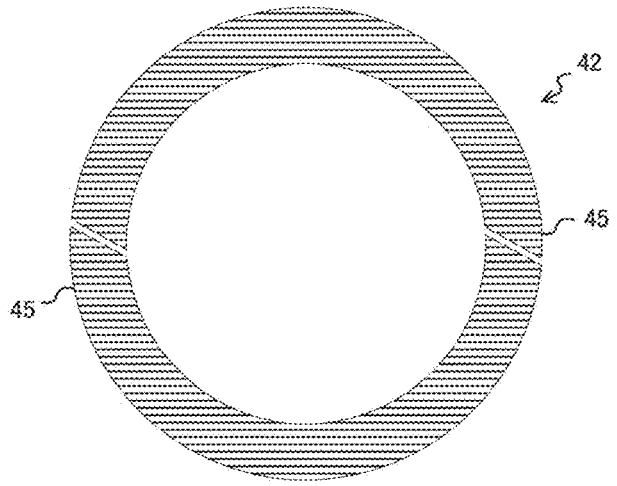

FIG. 14 includes schematic sectional views illustrating the middle heat insulating material 42 according to a modification example of Embodiment 1. FIG. 14 illustrates sections of the hot water storage tank 1 in the horizontal direction, that is, sections of the middle heat insulating material 42 solely extracted from a section corresponding to a section taken along B-B in FIG. 1. FIG. 14(*a*) illustrates the middle heat insulating material 42 divided in a front-rear direction when a lower part of the figure is directed frontward. FIG. 14(*b*) illustrates the middle heat insulating material 42 divided in a left-right direction. As illustrated in FIG. 14, the middle heat insulating material 42 of the hot water storage tank 1 may be cut in the up-down direction to be divided in the front-rear direction or the left-right direction. That is, the middle heat insulating material 42 is divided into one and the other portions, which are a plurality of middle heat insulating portions 45 and are disposed to face each other in the horizontal direction. The middle heat insulating material 42 is divided into the plurality of middle heat insulating portions 45, thus improving the ease of assembly, the ease of safekeeping, and the yield.

In addition, as illustrated in FIG. 14, when the middle heat insulating material 42 is cut in the up-down direction to be divided into the plurality of middle heat insulating portions 45, it is preferable to form respective side end faces of the plurality of middle heat insulating portions 45 as inclined surfaces having the same inclined angle in a horizontal plane of the hot water storage tank 1. Thus, it is possible to reduce costs for production of the middle heat insulating portions 45 by using the same forming metal mold.

In addition, in the description of Embodiment 1, the lower heat insulating material 41 covers the bottom 21 and a part, located lower than the center of the side 22, of the side 22 of the tank body 2, and the upper heat insulating material 43 covers the top 23 and a part, located higher than the center of the side 22, of the side 22 of the tank body 2. However, the lower heat insulating material 41 may cover only the bottom 21 of the tank body 2, the upper heat insulating material 43 may cover only the top 23 of the tank body 2, and the middle heat insulating material 42 may cover the entire side 22. Also in this case, the distance between the inner peripheral surface of the middle heat insulating material 42 and a part, facing the inner peripheral surface of the middle heat insulating material 42, of the outer peripheral surface of the tank body 2 is larger than the distance between the upper end of the inner peripheral surface of the lower heat insulating material 41 and a part, facing the upper end of the inner peripheral surface of the lower heat insulating material 41, of the outer peripheral surface of the tank body 2. In addition, the distance between the inner peripheral surface of the middle heat insulating material 42 and a part, facing the inner peripheral surface of the middle heat insulating material 42, of the outer peripheral surface of the tank body 2 is larger than the distance between the lower end of the inner peripheral surface of the upper heat insulating material 43 and a part, facing the lower end of the inner peripheral surface of the upper heat insulating material 43, of the outer peripheral surface of the tank body 2. Accordingly, when the middle heat insulating material 42 is attached, a gap is left between the outer surface of the body of the hot water storage tank 1 and the inner surface of the middle heat insulating material 42. However, the tank body 2 in use bulges when, for example, hot water is stored in the tank body 2. Thus, the inner peripheral surface of the middle heat insulating material 42 is located along the side 22 of the tank body 2.

In addition, in the example of Embodiment 4, a material whose Young's modulus is smaller than the Young's modulus of a material for the heat insulating materials is used for the cylindrical portions. However, a material whose Young's modulus is equal to or smaller than the Young's modulus of a material for the heat insulating materials may be used for the cylindrical portions. In addition, a common material may be used for the cylindrical portions and the heat insulating materials. In this case, the cylindrical portions and the heat insulating material may be integrally formed with each other.

In addition, in Embodiment 6, the ejection ports 31*a* and 31*b* for the upper pipe 32*c* and the hot water supply pipe 32*d* are formed inside the region defined by the three contact portions 80. However, only one of the ejection ports 31*a* and 31*b* may be formed inside the region defined by the three contact portions 80. In addition, the number of contact portions 80 may be four or more.

In addition, in the example of Embodiment 7, the upper end face 422 of the middle heat insulating material 42 and the lower end face 431 of the upper heat insulating material 43 are formed as inclined surfaces provided for the sides 22. However, it is sufficient that the upper end face 422 of the middle heat insulating material 42 and the lower end face 431 of the upper heat insulating material 43 be provided at least for the side 22 connected to the long side L of the bottom 21. That is, it is sufficient that a part of the upper end face 422 of the middle heat insulating material 42 and a part of the lower end face 431 of the upper heat insulating material 43, the part of the upper end face 422 and the part of the lower end face 431 facing the side 22 connected to the long side L of the bottom 21, be formed as inclined surfaces. Also in this case, it is possible to reduce the amount of heat transferred from the tank body 2F in use when hot water is stored in the tank body 2F.

In addition, the configurations of Embodiments described above may be combined as appropriate. For example, the hot water storage tank 1 in Embodiment 1 may include the cylindrical portions. In addition, the hot water storage tank 1F in Embodiment 7 may include the housing 70.

REFERENCE SIGNS LIST

1: hot water storage tank, 1A: hot water storage tank, 1B: hot water storage tank, 1C: hot water storage tank, 1D: hot water storage tank, 1E: hot water storage tank, 1F: hot water storage tank, 2: tank body, 2F: tank body, 21: bottom, 22: side, 23: top, 31*a*: ejection port, 31*b*: ejection port, 31*c*: ejection port, 31*d*: ejection port, 32*a*: bottom pipe, 32*b*: water supply pipe, 32*c*: upper pipe, 32*d*: hot water supply pipe, 41: lower heat insulating material, 42: middle heat insulating material, 43: upper heat insulating material, 45: middle heat insulating portion, 51*c*: insertion hole, 51*d*: insertion hole, 51*a*: insertion hole, 51*b*: insertion hole, 61*a*: cylindrical portion, 61*b*: cylindrical portion, 61*c*: cylindrical portion, 61*d*: cylindrical portion, 70: housing, 71: bottom plate, 72: side plate, 73: top plate, 80: contact portion, 412: upper end face, 421: lower end face, 422: upper end face, 431: lower end face

The invention claimed is:

1. A hot water storage tank comprising:

a tank body that stores a liquid;

a lower heat insulating material covering a lower part of the tank body;

a middle heat insulating material connected to the lower heat insulating material, the middle heat insulating material covering a side part of the tank body; and an upper heat insulating material connected to the middle heat insulating material, the upper heat insulating material covering an upper part of the tank body, a lower end face of the upper heat insulating material and an upper end face of the middle heat insulating material being inclined downward from insides toward outsides, an outer diameter of the middle heat insulating material being larger than an outer diameter of the upper heat insulating material, the outer diameter of the middle heat insulating material being larger than an outer diameter of the lower heat insulating material, and an upper end face of the lower heat insulating material and a lower end face of the middle heat insulating material are inclined upward from insides toward outsides.

2. The hot water storage tank of claim 1, wherein a distance between an inner peripheral surface of the middle heat insulating material and a part, facing the middle heat insulating material, of an outer peripheral surface of the tank body is larger than a distance between an upper end of an inner peripheral surface of the lower heat insulating material and a part, facing the upper end of the inner peripheral surface of the lower heat insulating material, of the tank body and is larger than a distance between a lower end of an inner peripheral surface of the upper heat insulating material and a part, facing the lower end of the inner peripheral surface of the upper heat insulating material, of the tank body.

3. The hot water storage tank of claim 1, wherein the lower end face of the upper heat insulating material and the upper end face of the middle heat insulating material have a smaller inclined angle than an inclined angle of a lower end face of the middle heat insulating material and an upper end face of the lower heat insulating material.

4. The hot water storage tank of claim 1, wherein the upper heat insulating material is in contact with a top of the tank body, and the lower heat insulating material is in contact with a bottom of the tank body.

5. The hot water storage tank of claim 1, further comprising a cylindrical portion provided between the tank body and the lower heat insulating material or the upper heat insulating material, wherein the tank body has an ejection port connected to a pipe through which a liquid flows, and the cylindrical portion has an opening passing through in an up-down direction, the opening facing the ejection port, and is disposed to surround the ejection port.

6. The hot water storage tank of claim 5, wherein the cylindrical portion is formed separately from the lower heat insulating material and the upper heat insulating material.

7. The hot water storage tank of claim 5, wherein the cylindrical portion is made of a flexible material whose Young's modulus is smaller than a Young's modulus of a material for the lower heat insulating material, the middle heat insulating material, and the upper heat insulating material.

8. The hot water storage tank of claim 5, further comprising a housing that houses the tank body, the upper heat insulating material, the middle heat insulating material, and the lower heat insulating material, wherein the housing includes a bottom plate forming a lower part of the housing, a side plate connected to the bottom plate, the side plate forming a side part of the housing, and a top plate connected to the side plate, the top plate forming an upper part of the housing, the top plate is in contact with the upper heat insulating material at three contact portions and exerts downward force on the upper heat insulating material, and the upper heat insulating material has an insertion hole through which the pipe passes, the insertion hole communicating with the ejection port inside a triangle formed by the three contact portions.

9. The hot water storage tank of claim 1, further comprising a housing that houses the tank body, the upper heat insulating material, the middle heat insulating material, and the lower heat insulating material, the housing including a bottom plate forming a lower part of the housing, a side plate connected to the bottom plate, the side plate forming a side part of the housing, and a top plate connected to the side plate, the top plate forming an upper part of the housing, the top plate exerting downward force on the upper heat insulating material.

10. The hot water storage tank of claim 1, wherein the middle heat insulating material is formed by a plurality of middle heat insulating portions into which the middle heat insulating material is divided in a horizontal direction, and the plurality of middle heat insulating portions have side end faces inclined and identical in inclination in a horizontal plane.

11. The hot water storage tank of claim 1, wherein the tank body has a cuboid shape, and the middle heat insulating material and the upper heat insulating material cover a side connected to a long side of a bottom of the tank body.

12. A hot water storage tank comprising:

a tank body that stores a liquid;

a lower heat insulating material covering a lower part of the tank body;

a middle heat insulating material connected to the lower heat insulating material, the middle heat insulating material covering a side part of the tank body; and an upper heat insulating material connected to the middle heat insulating material, the upper heat insulating material covering an upper part of the tank body, a lower end face of the upper heat insulating material and an upper end face of the middle heat insulating material being inclined downward from insides toward outsides, an outer diameter of the middle heat insulating material being larger than an outer diameter of the upper heat insulating material, the outer diameter of the middle heat insulating material being larger than an outer diameter of the lower heat insulating material, and a cylindrical portion provided between the tank body and the lower heat insulating material or the upper heat insulating material, wherein the tank body has an ejection port connected to a pipe through which a liquid flows, the cylindrical portion has an opening passing through in an up-down direction, the opening facing the ejection port, and is disposed to surround the ejection port, and the cylindrical portion is formed separately from the lower heat insulating material and the upper heat insulating material.

13. The hot water storage tank of claim 12, wherein the middle heat insulating material is formed by a plurality of middle heat insulating portions into which the middle heat insulating material is divided in a horizontal direction, and the plurality of middle heat insulating portions have side end faces inclined and identical in inclination in a horizontal plane.

14. The hot water storage tank of claim 12, wherein the tank body has a cuboid shape, and the middle heat insulating material and the upper heat insulating material cover a side connected to a long side of a bottom of the tank body.

15. A hot water storage tank comprising:

a tank body that stores a liquid;

a lower heat insulating material covering a lower part of the tank body;

a middle heat insulating material connected to the lower heat insulating material, the middle heat insulating material covering a side part of the tank body; and an upper heat insulating material connected to the middle heat insulating material, the upper heat insulating material covering an upper part of the tank body, a lower end face of the upper heat insulating material and an upper end face of the middle heat insulating material being inclined downward from insides toward outsides, an outer diameter of the middle heat insulating material being larger than an outer diameter of the upper heat insulating material, the outer diameter of the middle heat insulating material being larger than an outer diameter of the lower heat insulating material, and a cylindrical portion provided between the tank body and the lower heat insulating material or the upper heat insulating material, wherein the tank body has an ejection port connected to a pipe through which a liquid flows, the cylindrical portion has an opening passing through in an up-down direction, the opening facing the ejection port, and is disposed to surround the ejection port, and the cylindrical portion is made of a flexible material whose Young's modulus is smaller than a Young's modulus of a material for the lower heat insulating material, the middle heat insulating material, and the upper heat insulating material.

16. The hot water storage tank of claim 15, wherein the middle heat insulating material is formed by a plurality of middle heat insulating portions into which the middle heat insulating material is divided in a horizontal direction, and the plurality of middle heat insulating portions have side end faces inclined and identical in inclination in a horizontal plane.

17. The hot water storage tank of claim 15, wherein the tank body has a cuboid shape, and the middle heat insulating material and the upper heat insulating material cover a side connected to a long side of a bottom of the tank body.

* * * * *